US006079329A

United States Patent [19]

Goovaard et al.

[11] Patent Number: 6,079,329

[45] Date of Patent: Jun. 27, 2000

[54] METHOD FOR PRODUCING PRINTED MATTER AND PRINTING FORM ATTACHMENT MEANS FOR USE IN THE METHOD

[75] Inventors: Jan Goovaard, St. Oedenrode; Hendrik Nijen Twilhaar, Amersfoort; Jan Willem Boers, Nijkerk, all of Netherlands

[73] Assignee: Winkle Holding, B.V., Amersfoort, Netherlands

[21] Appl. No.: 09/206,025

[22] Filed: Dec. 4, 1998

Related U.S. Application Data

[60] Division of application No. 08/966,498, Nov. 7, 1997, which is a continuation-in-part of application No. 08/669,413, Sep. 23, 1996, Pat. No. 5,715,750.

[30] Foreign Application Priority Data

Jan. 13, 1995 [WO] WIPO ..... PCT/NL95/00016

[51] Int. Cl.[7] ..... B41F 13/10

[52] U.S. Cl. ..... 101/376; 101/382.1; 101/401.1

[58] Field of Search ..... 101/376, 395, 101/401, 401.1, 453, 460, 465, 467, 456, 457, 462, 382.1, 375, 378

[56] References Cited

U.S. PATENT DOCUMENTS

| | | | |
|---|---|---|---|
| 3,146,709 | 9/1964 | Bass et al. | 101/375 |
| 3,210,187 | 10/1965 | Thommes . | |
| 3,903,794 | 9/1975 | Grupe et al. | 101/376 |
| 4,092,925 | 6/1978 | Fromson | 101/467 |
| 4,871,631 | 10/1989 | Pieper et al. . | |
| 4,903,597 | 2/1990 | Hoage et al. | 101/401.1 |
| 5,284,091 | 2/1994 | Kon et al. | 101/378 |
| 5,325,776 | 7/1994 | Rather, Sr. et al. | 101/382.1 |
| 5,410,963 | 5/1995 | Steadman | 101/376 |

FOREIGN PATENT DOCUMENTS

| | | |
|---|---|---|
| 0281770 | 9/1988 | European Pat. Off. . |
| 0313510 | 4/1989 | European Pat. Off. . |
| 0452808 | 10/1991 | European Pat. Off. . |
| 2214136 | 8/1974 | France . |
| 2848830 | 9/1979 | Germany . |
| 58-160956 | 12/1983 | Japan . |
| 1188396 | 7/1989 | Japan . |
| 1210343 | 8/1989 | Japan . |
| 5179208 | 7/1993 | Japan . |
| 5320593 | 12/1993 | Japan . |

*Primary Examiner*—Christopher A. Bennett
*Attorney, Agent, or Firm*—Akin, Gump, Strauss, Hauer & Feld, L.L.P.

[57] ABSTRACT

A method for producing printed matter comprises the steps of preparing a flexographic printing form, providing a printing form attachment means having an adherent sticky surface area on a plate cylinder of a printing press, removably attaching the flexographic printing form to the said printing form attachment means and thus to the plate cylinder and printing the printed matter on the printing press using the thus removably attached flexographic printing form. A method of this kind is improved advantageously by the invention in that it comprises the further steps of providing a polymeric layer and treating the said polymeric layer using suitable means so as to obtain a polymeric layer having an adherent and sticky surface area, placing the treated polymeric layer on a plate cylinder of the printing press, arranging the flexographic printing form on the treated polymeric layer, using the sticky and adherent properties of the said surface area for the removable attachment of the flexographic printing form on the plate cylinder and producing the printed matter on the printing press with the flexographic printing form thus removably attached to the plate cylinder of the printing press by the adherent and sticky properties of the treated polymeric layer.

The invention also provides printing form attachment means to be used in the method and having a polymeric layer which has been treated by suitable means so as to obtain an adherent and sticky surface area suitable for the removable attachment of a flexographic printing form on a printing press.

22 Claims, 3 Drawing Sheets

METHOD FOR PRODUCING PRINTED MATTER AND PRINTING FORM ATTACHMENT MEANS FOR USE IN THE METHOD

CROSS-REFERENCE TO RELATED APPLICATIONS

This application is a divisional application of U.S. application Ser. No. 08/966,498, filed on Nov. 7, 1997, which is a continuation in part of U.S. application Ser. No. 08/669,413, filed on Sep. 23, 1996, now issued as U.S. Pat. No. 5,715,750.

BACKGROUND OF THE INVENTION

This invention relates to a method for producing printed matter using a flexographic printing form as well as to an attachment means for attaching a flexographic printing form or other printing type, particularly a printing form of photopolymeric material, on a plate cylinder or similar printing type carrier of a printing machine.

In known methods of this type a strip of double-sided adhesive tape is applied to a roll, attached with the one adherent side on the plate cylinder so that on the other adherent side one or more flexographic printing forms can be attached. The flexographic printing form itself consist of a photopolymeric layer applied to a supporting layer. Through a film, on which the desired pictures and/or text etc. have been recorded, the photopolymeric layer is exposed and then washed out, whereafter finally the resulting printing form is subjected to a subsequent treatment. In case of using the known method the problem arises that the supporting layer of the printing form adheres strongly to the adherent layer of the attachment means, due to which removal of the printing form after finishing a printing run is troublesome and moreover a residual part of the adherent layer often remains on the printing form. Consequently the attachment means generally has to be replaced after use one or more times, whereas on the other hand the printing form has to be cleansed in order to remove the adherent layer. Because the cleansing operation of the printing form is intensive the printing form is commonly thrown away. Thus in case of a repeat order for further printed matter of the same type a new printing form has to be produced and used for further printing.

SUMMARY OF THE INVENTION

It is an object of this invention to provide a method for printing printed matter and attachment means for the flexographic printing plates which overcome these disadvantages in a simple, but nevertheless effective way and produce printed matter having improved printing quality at lower overall costs.

In accordance with the invention the method comprises the steps of providing a polymeric layer and treating the said polymeric layer using suitable means so as to obtain a polymeric layer having an adherent and sticky surface area, attaching the treated polymeric layer on a plate cylinder of the printing press, arranging the flexographic printing form on the treated polymeric layer, using the sticky and adherent properties of the said surface area for the removable attachment of the flexographic printing form on the plate cylinder and producing the printed matter on the printing press with the flexographic printing form removably attached to the plate cylinder of the printing press by the adherent and sticky properties of the treated polymeric layer.

The invention relies on the recognition that in order to obtain a particularly effective method for the production of printed matter, advantageously the adherent characteristics of a polymeric layer can be utilized. Experiments have shown that these adherent characteristics may be preserved in case of intensive use during a period of at least 8 to 12 months. Moreover, on the one hand a good attachment of the printing form on the plate cylinder is realized, whereas on the other hand the printing form can relatively easily be removed from the adherent polymeric layer and no residual polymeric material remains on the printing form. This results in a long lifetime of the attachment means applied to the plate cylinder, whereas on the other hand the printing form no longer needs to undergo a cleansing operation for removing any residual adherent layer material. Damaging of the printing form by such removal is consequently excluded as well, so that the printing form is available several times for repeat orders without any problem.

Moreover, the attachment means of the invention has the advantage that the polymeric layer can be chosen to be highly resistant to the solvents present in the used inks. A further important advantage is achieved in that the polymeric layer as compared with the adherent layers of the known attachment means may have a considerable thickness and a relatively low hardness and may have a thickness of 0.5–20 mm. In this way the polymeric layer of the attachment means may form a kind of resilient layer between the printing form and the plate cylinder, which results in taking away the unavoidable non-circular shapes of the plate cylinder and printing forms and tolerance due to gear abrasion by the polymeric layer. This aspect induces a considerable lifetime increase of the moving parts of the printing press, as well as lifetime increase of the printing form. An accompanying important advantage is that the thickness of the printing form itself can be considerably less than the required thickness, because of the fact that a relatively thick polymeric layer of the attachment means may already provide an important part of the required total height of the embossed printing above the plate cylinder. It will be understood that application of relatively thin printing forms will induce a considerable economy of 25–40% Moreover, not only a reduction of cost but also a better printing quality in case of printing on relatively rough materials is achieved.

In a highly interesting embodiment of the invention, resulting in printed matter of superior quality, a resilient foam backing layer is provided on the rear side of the said adherent and sticky surface area, so that after attachment of the printing form attachment means to the plate cylinder, the said foam backing layer is interposed between the adherent and sticky surface area and the plate cylinder. Advantageously, the backing layer may be a polyurethane foam layer. The foam layer may be interposed between adhesive layers, so that it will stick to the printing form attachment means on one side and to the plate cylinder on the other side.

According to a further advantageous embodiment, the attachment means of the invention is provided with reference markers printed e.g. on the polymeric layer or the supporting layer. Advantageously the transparent characteristics of the polymeric material for putting the printing form in the correct position on the plate cylinder are utilized herein. In this way putting the printing form(s) on the plate cylinder can take place rapidly and precisely, no expensive auxiliary apparatus for recording different printing forms on subsequent plate cylinders being necessary.

BRIEF DESCRIPTION OF THE DRAWINGS

The invention will be explained more in detail by means of the drawings, which illustrate highly schematically some exemplary embodiments of the attachment means of the invention for use in the method of the invention.

DETAILED DESCRIPTION OF THE INVENTION

Figure 1:
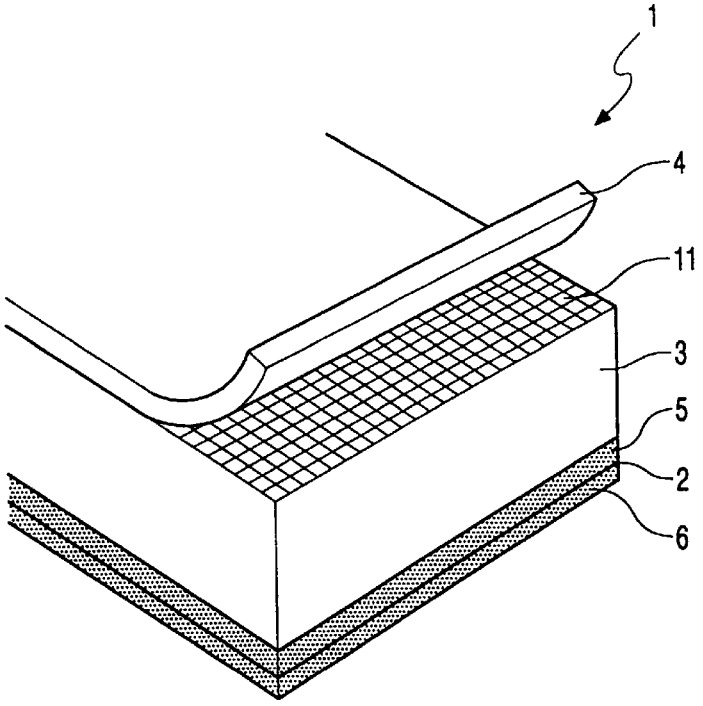
FIG. 1 represents a perspective view of the end of a web of an embodiment of the printing form attachment means of the invention applied to a roll (not shown).

In FIG. 1 the end of a web of printing form attachment means 1, hereafter simply referred to as "attachment means", is illustrated in a perspective view on a highly exaggerated scale in the thickness direction. Also different parts of the web may be on different scales. It will be understood that in a practical embodiment the attachment means 1 will have a considerably larger width than the width shown in FIG. 1. The attachment means 1 includes a dimensionally stable but flexible supporting or stabilizing layer 2 consisting of e.g. a polyester material. This supporting layer supports a polymeric layer 3 covered by a protective layer 4. For example, this protective layer 4 can consist of polyester as well. In the exemplary embodiment illustrated in FIG. 1 the supporting layer 2 is provided on both sides with an adherent layer 5 and 6 respectively, the adherent layer 5 connecting the polymeric layer 3 with the supporting layer 2 and the adherent layer 6 serving to attach the attachment means 1 on a plate cylinder partly visible in FIG. 2. Alternatively the supporting layer 2 can be embodied without the adherent layers 5, 6, the polymeric layer being united with the supporting layer 2 in another way and the attachment means being attached on the plate cylinder 7 in another way, e.g. by a commonly used double-sided adhesive tape.

A suitable polymeric layer may comprise a photopolymeric layer which is completely exposed using a suitable light source, for example ultra violet light. A suitable UV-curable photopolymeric material may be obtained from several sources, for example from Asahi Chemical Industry in Tokyo, Japan, the MacDermid company in Wellington, Del., USA or the BASF company in Stuttgart, Germany.

Another suitable polymeric layer may comprise a thermally curable polymer material which may be thermally treated using a suitable heat source such as for example an infrared radiation source to produce the required sticky adherent surface properties. A suitable thermally curable polymer material may be obtained from the Johnson Polymer company in the USA or from the BASF company in Germany.

In a convenient embodiment of the protective layer 4 a separate protective layer for the adherent layer 6 can be omitted when the attachment means 1 is supplied on a roll. Alternatively it is of course possible to apply a separate removable protective layer on the adherent layer 6.

When applying the polymeric layer 3 in the attachment means 1 as described above the characteristic of the polymeric material being sticky or adherent after treatment is utilized advantageously. In case of application of photopolymeric material for producing flexographic printing forms in a conventional way, after washing out the printing form a subsequent treatment of the printing form is carried out in order to dissolve the stickiness of the exposed photopolymeric material. The present invention relies on the recognition that such sticky or adherent characteristic of a polymeric material makes a polymeric layer particularly suitable for application as an adherent layer in the attachment means as described above. If the polymeric layer 3 comprises a photopolymeric material, it is exposed completely, which results in a further wetting of the photopolymer.

Figure 2:
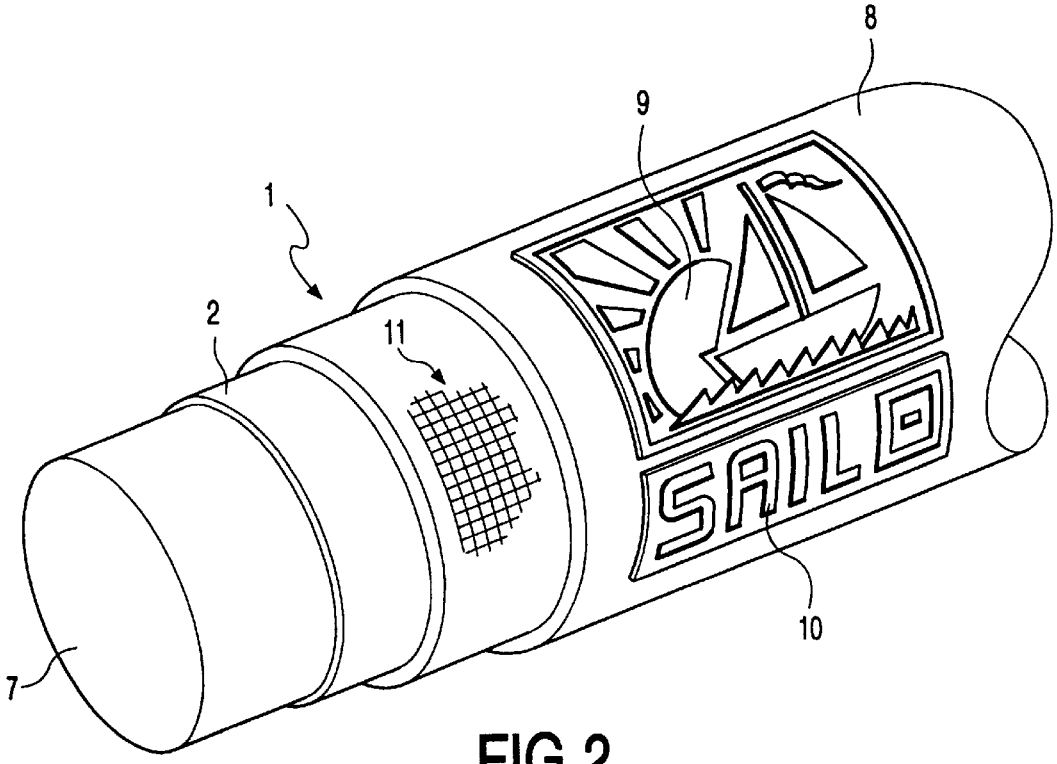
FIG. 2 represents a perspective view of the one end of a plate cylinder, on which a printing form by means of a piece of the printing form attachment means of FIG. 1 is applied.

In FIG. 2 the one end of the plate cylinder 7, on which a piece of the attachment means 1 of FIG. 1 is applied, is illustrated in a perspective view. The polymeric layer 3 is partially broken away so that the supporting layer 2 is partially visible. Furthermore a printing form 8 is illustrated, on which highly schematically pictures 9 and text 10 are indicated. This printing form 8 is embodied in a conventional way with a photopolymeric layer and a supporting layer, on which pictures 9 and text 10 are shaped by way of exposure through a film, then washing out and finally a subsequent treatment in the photopolymeric layer.

Due to the application of the treated polymeric layer 3 to the attachment means 1 as described above the advantage is achieved that on the one hand the printing form 8 can be attached correctly upon the plate cylinder 7 and on the other hand it can easily be removed as well. In this way no residual material remains on the supporting layer 8 of the printing form so that this printing form 8 needs not undergo any special cleansing operation and does not break down. As a result the printing form 8 maintains its availability for repeat orders. Furthermore the attachment means 1 has the advantage that when removing the printing form 8 the polymeric layer 3 does not get damaged so that the attachment means has a long lifetime. Experiments have shown that with a photopolymeric layer this lifetime amounts to at least 8 to 12 months. For the user of the attachment means of the invention this means a considerable economy, since when using a conventional attachment means it generally has to be replaced after removal of a printing form one or more times, whereas as a result of the remaining of glue residues on the printing form it mostly has to be thrown away. A further important advantage is that the printing form attachment means remain on the plate cylinder so that it is not necessary to clean the plate cylinder after each printing run to remove residual adhesive material from the adhesive tape used. Printing therefore may be resumed more quickly, resulting in lower over-all printing costs.

As appears from the drawings the polymeric layer 3 has a considerable thickness with respect to the adherent layers 5, 6. This results in advantageous utilization of the resilient characteristic of the polymeric layer 3, as a consequence of which any influence due to any non-circular shape of the plate cylinder and the suspension of the plate cylinder can be absorbed at least partly and a considerable noise reduction and a lifetime increase of the printing press may be achieved. Moreover a relatively resilient support of the printing form 8 is realized, which increases the lifetime of the printing form. The quality of the printed matter is also improved, particularly in case of printing on rough material.

Furthermore, applying of the relatively thick polymeric layer 3 on the attachment means 1 has the advantage that the thickness of the printing form 8 can be smaller so that a considerable economy of 25 to 40% on material costs for producing the printing forms can be realized.

As indicated schematically in FIG. 1 and 2, reference markers 11 are printed on the polymeric layer 3 so that before applying the printing forms on the plate cylinder after applying the attachment means 1 upon the plate cylinder 7 reference markers for positioning the printing forms are available. In this way the user can rapidly and precisely locate printing forms at the desired place. Alternatively it is possible to print the reference markers 11 on the supporting layer 2 in case of a suitable embodiment of the connection between the supporting layer and the polymeric layer.

The polymeric layer 3 can have various thickness ranging from e.g. 0.5 to 20 mm, dependent on the desire of the user. The thickness to be applied is dependent on the required height of the printing form for the relative printing press or the diameter of the combination of plate cylinder and printing form attachment means. A suitable chosen polymeric material may have the advantage that it is resistant to the solvents present in the used inks, as well as to the influence of ozone.

It has to be noted that for applying the attachment means on a magnetic plate cylinder the attachment means can be provided with a thin metallic sheet. Alternatively the attachment means can be laminated with a magnetic foil.

Figure 3:
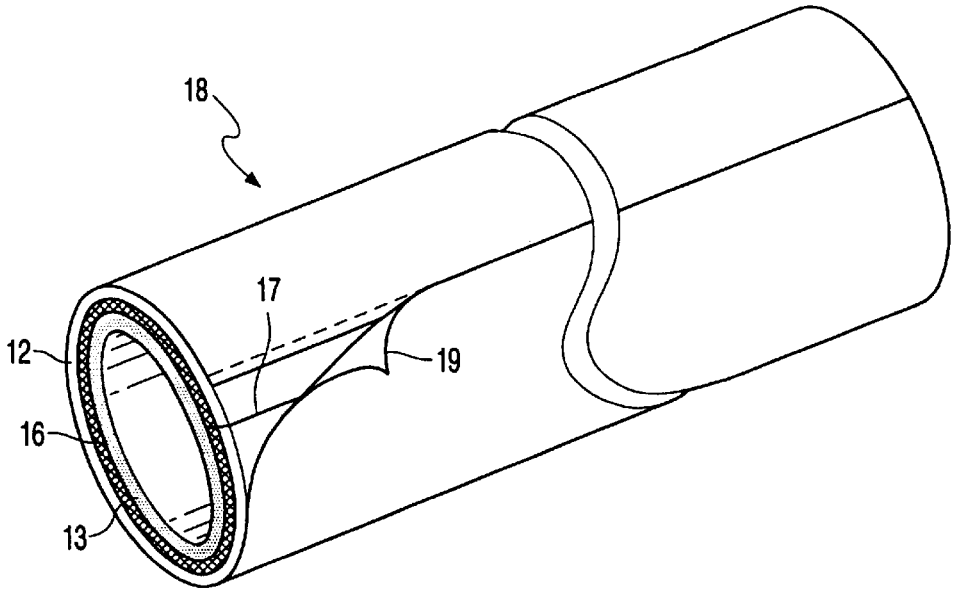
FIG. 3 represents a perspective view of an embodiment of the invention in which the printing form attachment means is arranged on a substantially rigid sleeve.
Figure 4:
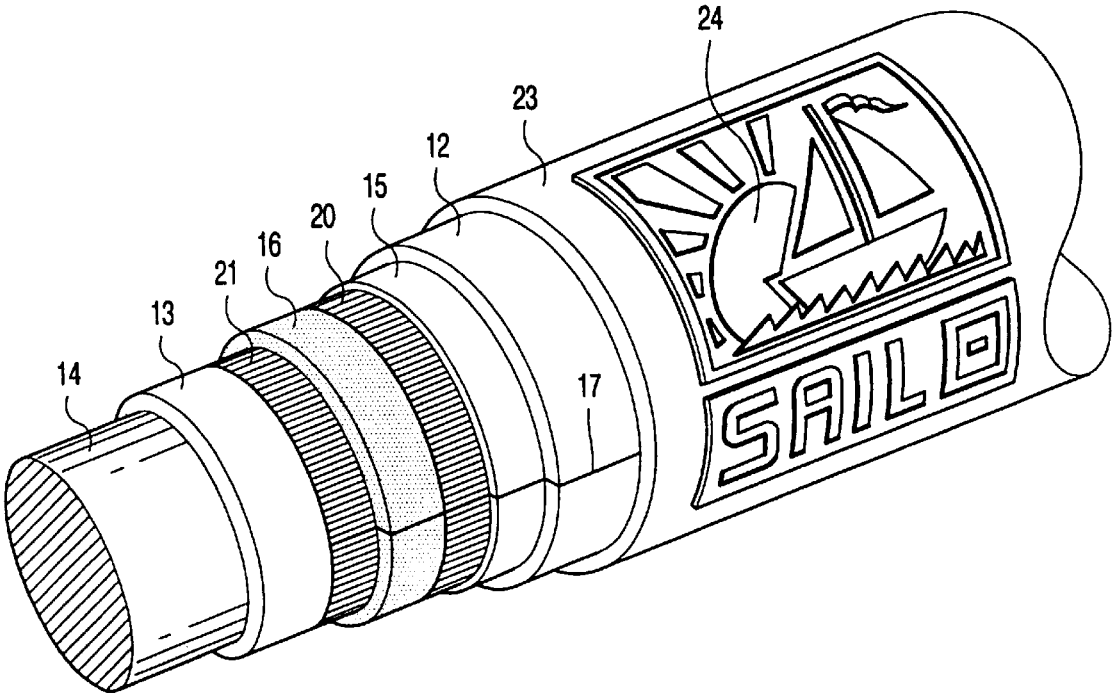
FIG. 4 represents a perspective view similar to FIG. 2 of the embodiment of the attachment means of FIG. 3, mounted on a plate cylinder of a printing press.

An advantageous embodiment of the invention is shown schematically in FIGS. 3 and 4. According to this embodiment the printing form attachment means comprises a treated polymeric printing form attachment layer 12 which is made of a polymeric material which is adapted to be located on the plate cylinder for removable adherent attachment of a printing form on a plate cylinder utilizing the sticky and adherent characteristics of the polymeric material. This attachment layer is arranged on the outside of a substantially rigid support sleeve 13 having a hollow inside diameter which is adapted to the outside diameter of the plate cylinder 14 (FIG. 4) of the printing machine. The sleeve 13 is adapted to be mounted onto the plate cylinder 14. It should be noted here that sleeves of this kind are known in the prior art for use on printing cylinders for adapting the outer diameter of the printing cylinder to different kinds of printed matter to be printed on the printing press. Mounting of such sleeves on printing cylinders is generally carried out by using an air pressure film between the plate cylinder and the sleeve. The air pressure film provides a practically frictionless interface between the plate cylinder and the sleeve and also slightly expands the sleeve. After cutting of the air supply to the air film the air film will disappear and the sleeve will contract enough to clamp it firmly onto its place on the plate cylinder.

The polymeric layer 12 is arranged on a flexible but dimensionally stable support layer 15. The polymeric material of the polymeric layer 12 itself may be dimensionally rather unstable and have relatively high resilience in all directions. Due to the presence of the dimensionally stable support layer the combination of the support layer and the photopolymeric layer is resilient substantially only in the direction normal to the polymeric layer.

Also present is a resilient foam backing layer 16 on the side of the support layer 15 opposite to the polymeric printing form attachment layer 12. The presence of a foam backing layer of this kind has proven to be highly contributory to achieving high printing quality. In cases such as shown in FIGS. 3 and 4 where a resilient foam backing layer is used a polymeric layer 12 of reduced thickness may be used having a hardness which is higher than that of the foam backing layer. A suitable backing layer material is a polyurethane foam. Suitable resilient foam backing material is provided for example by the Rogers Corporation from East Woodstock, Conn., USA and available under the brand name R/bak.

As shown in FIG. 3 the polymeric layer 12 may be part of a web similar to the web of FIG. 1 and cut to size to fit on the outer surface of the support sleeve 13. FIGS. 3 and 4 show the seam 17 which will be present on the surface of the photopolymeric layer 12 in such a case. Careful manufacture however will guarantee that the seam 17 will be practically unobservable and will have no detrimental effect on printing quality.

Figure 5:
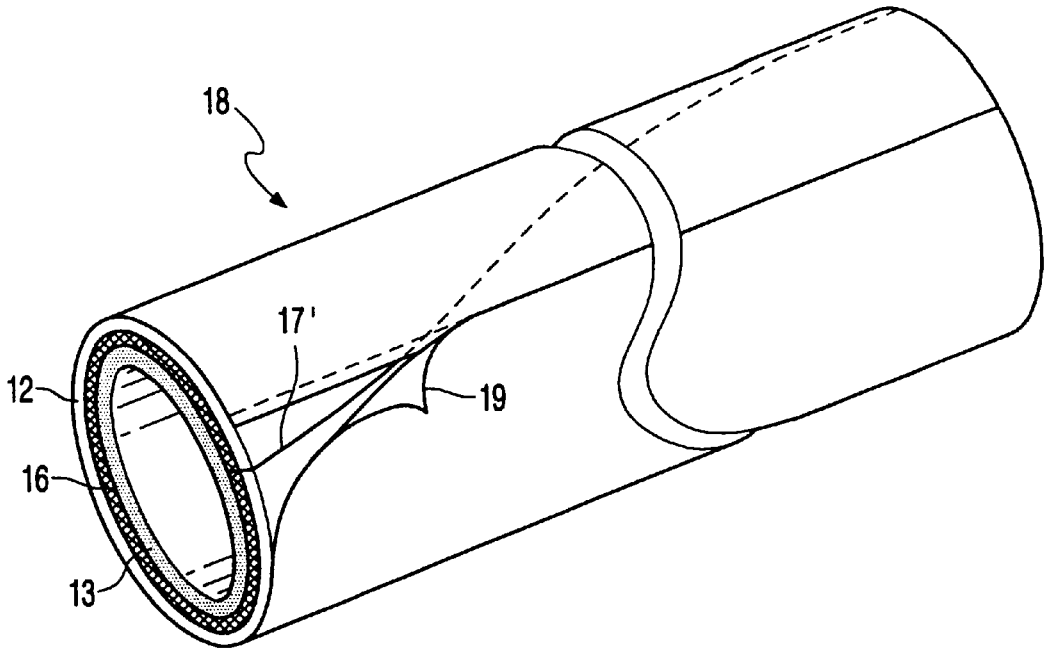
FIG. 5 represents a perspective view similar to FIG. 3 but of a modified embodiment.

FIG. 5 shows a modification of the printing form attachment means of FIG. 3. Similar reference numbers have been used to designate similar parts. In this embodiment the seam 17' does not extend at right angles relative to the side edges of the web type article which has been arranged on the support sleeve 13. Instead it encloses an angle to the side edges so that the seam presents a helical orientation. Such a helical orientation may be preferable to avoid a sudden transition in the circumferential direction between one generally transverse edge of the web to the other generally transverse edge.

The printing form attachment means 18 shown in FIG. 3, comprising the polymeric layer 12, the support sleeve 13, the support layer 15 and the foam backing layer 16 may be provided by a manufacture as a complete unit to the printing industry in various suitable sizes. As shown in FIG. 3 the outer surface of the polymeric layer 12 may be protected by a suitable peel-off layer 19, a corner of which has been peeled-off in FIG. 3 for illustration purposes. Suitable peel-off papers or other suitable peel-off layers are common in the industry. The support sleeve 13 in some cases may be slightly tapering to a very small extent to facilitate mounting on a plate cylinder. This however is also common in the art.

FIG. 4 indicates the presence of adhesive layers 20 and 21 on either side of the foam backing layer 16 to connect the foam backing layer to the support layer on one side and to the support sleeve 13 on the other side. The foam backing layer 16 may be provided with the adhesive layers 20 and 21 on both sides in web form or roll form, in which case one of the adhesive layers or both adhesive layers may be provided with a suitable peel-off layer which may be removed just before use.

As in FIG. 2 a flexographic printing form 23 may be arranged on the treated polymeric layer 12 using the sticky end adherent properties of the polymeric layer for the removable attachment of the flexographic printing form. On the printing form relieved parts such as the part 24 shown schematically and for illustrative purposes only in FIG. 4 may be present constituting the part which will contact the material to be printed.

The printing form attachment means of the several embodiments described before and shown in the drawing are used to advantage in the method for producing printed matter according to the invention. The method comprises attaching of the previously treated polymeric layer on a plate cylinder of a printing press using suitable means as described before such as double-sided adhesive tape, magnetic means, or by using a sleeve such as the support sleeve 13 shown in FIGS. 3 and 4 which is clamped on the plate cylinder of the printing press or by any other suitable means. In a further step the printing form is arranged in a suitable position on the sticky and adhesive surface area of the treated polymeric layer in any desired or suitable position. Markers may be present in or on the printing form attachment means to facilitate the correct positioning of the printing form. In case the printing form would not be perfectly positioned onto the polymeric layer of the printing form attachment means, it can be removed easily without damaging either the printing form or the polymeric layer of the printing form attachment means. Immediately after removal the printing form may be arranged on the printing form attachment means again.

If the printing form attachment means have been used previously for producing printed matter in a previous production run the surface of the polymeric layer of the printing form attachment means is preferably cleaned of any extraneous material such as dust and paper flints by cleaning the surface with a suitable volatile solvent. For the cleaning of photopolymeric layers, such solvent may include ethyl acetate, alcohol, naphtha etcetera. Any volatile solvent which is compatible with the material of the polymeric layer of the printing form attachment means may be used in principle. Cleaning the surface of the polymeric layer of the printing form attachment means after use has been proved to be highly beneficial to maintaining the sticky and adherent properties of the polymeric layer and can be carried out easily and quickly by hand, using a non-flint tissue and a suitable solvent.

After arranging the flexographic printing form on the treated polymeric layer and thus on the plate cylinder, the press may be started to produce the desired printed matter while the flexographic printing form is securely but removably attached to the plate cylinder of the printing press by the adherent and sticky properties of the completely exposed photopolymeric layer. After completion of the production run the press can be put to use again within a relatively short time to produce printed matter of a different kind by pulling the printing form away from the adherent and sticky polymeric layer of the printing form attachment means, cleaning the surface of the polymeric layer using a suitable evaporating solvent if necessary, arranging a new flexographic printing form on the sticky and adherent surface of the polymeric layer of the printing form attachment means, starting the press again and producing the further printed matter.

The invention is not limited to the exemplary embodiment as described in the foregoing, which can be varied in several ways within the scope of the invention.

We claim:

1. Method for producing printed matter, comprising the steps of:

preparing a flexographic printing form, providing a printing form attachment means with a polymeric layer and treating the polymeric layer using suitable means so as to obtain a polymeric layer having an adherent and sticky surface area, attaching the treated polymeric layer on a plate cylinder of the printing press, arranging the flexographic printing form on and removably attaching the flexographic printing form to the treated polymeric layer of the printing form attachment means, using the sticky and adherent properties of the sticky surface area for the removable attachment of the flexographic printing form on the plate cylinder, and printing the printed matter on the printing press with the flexographic printing form removably attached to the plate cylinder of the printing press by the adherent and sticky properties of the treated polymeric layer.

2. Method for producing printed matter according to claim 1, wherein the method further comprises the steps of:

providing the polymeric layer on a support layer, wherein the step of treating the polymeric layer is carried out while the polymeric layer is disposed on the support layer using suitable means to obtain the adherent and sticky surface area on the surface of the polymeric layer on the side opposing the support layer, and wherein the step of attaching the printing form attachment means on the plate cylinder is carried out by directing the support layer toward the plate cylinder and directing the sticky and adherent polymeric surface area away from the plate cylinder.

3. Method according to claim 1, wherein the polymeric layer of the printing form attachment means comprises a photopolymeric material and the treatment of the photopolymeric layer by suitable means comprises a completely exposing the layer to a suitable source of radiation.

4. Method according to claim 1, wherein the polymeric layer of the printing form attachment means comprises a thermally polymerizing material and the treatment of the polymeric layer by suitable means comprises a heat treating the layer using a suitable heat source.

5. Method according to claim 1, further comprising the steps of:

providing the printing form attachment means with reference markers prior to attaching it to the plate cylinder, and using the reference markers for accurate positioning of the flexographic printing form on the adherent and sticky surface area of the printing form attachment means.

6. Method according to claim 5, wherein the polymeric layer of the printing form attachment means is light transparent and the markers are provided on the support layer.

7. Method according to claims 5, wherein the reference markers are provided in the form of a grid of lines.

8. Method according to claim 1, further comprising removing the flexographic printing plate from the adherent and sticky surface area of the printing form attachment means subsequent to a printing run, cleaning the surface area with a suitable volatile solvent to remove foreign particles such as dust and paper particles from the surface area, attaching a different flexographic printing form to the said surface area using the sticky and adherent properties of the cleaned surface area for the attachment, and producing different printed matter with the attached different flexographic printing plate.

9. Method according to claim 2, further comprising providing the printing form attachment means as a web type article, and cutting off a suitable portion of the article such that the cut off portion is removably attached to the plate cylinder.

10. Method according to claim 1, further comprising providing the printing form attachment means with a thickness of 1 to 8 mm and providing the flexographic printing form with a reduced thickness approximately in accordance with the thickness of the printing form attachment means to provide a total thickness substantially equal to a thickness of previously known flexographic printing plates which were attached directly onto double sided adhesive tape provided on the plate cylinder.

11. Method according to claim 1, wherein the printing form attachment means has a front side on which the polymeric layer is located and a rear side, the method further comprising the step of providing double sided adhesive tape on at least one of the plate cylinder and the rear side of the printing form attachment means, and attaching the printing form attachment means on the plate cylinder by using the adherent properties of the double sided adhesive tape.

12. Method according to claim 1, further comprising providing a resilient foam backing layer on a rear side of the printing form attachment means, opposite to the side of the adherent and sticky surface area, so that after attachment of the printing form attachment means to the plate cylinder, the backing layer is interposed between the adherent and sticky surface area and the plate cylinder.

13. Method according to claim 12, wherein the said backing layer is a polyurethane foam layer.

14. Method according to claim 12, wherein the backing layer is a part of a double sided adhesive tape provided between the plate cylinder and the printing form attachment means.

15. Method according to claim 9, further comprising providing the web type article with a peel-off protection layer over the polymeric layer and a double sided adhesive tape over the support layer.

16. Method according to claim 1, further comprising the steps of:

providing a substantially rigid cylindrical support sleeve having a hollow inside diameter sized to the outside diameter of a plate cylinder of a printing machine, wherein the step of providing the printing form attachment means further includes providing the treated polymeric layer on an outer surface of the support sleeve, the support sleeve and the treated polymeric layer together forming a cylindrical printing form attachment means, mounting the cylindrical printing form attachment means on a plate cylinder of a printing machine, wherein the step of arranging the flexographic printing form on and removably attaching the flexographic printing form to the treated polymeric layer of the printing form attachment means includes arranging the flexographic printing form on the treated polymeric layer of the cylindrical printing form attachment means using the sticky and adherent properties of the said surface area for the removable attachment of the flexographic printing form on the plate cylinder, such that the printed matter on the printing press is produced with the flexographic printing form removably attached to the plate cylinder of the printing press by the adherent and sticky surface area of the treated polymeric layer of the cylindrical printing form attachment means.

17. Method according to claim 16, further comprising providing the cylindrical printing form attachment means as a separate article having a peel-off layer provided on the adherent and sticky outer surface of the treated polymeric surface, and removing the peel-aft layer prior to the arranging of the flexographic printing plate on the adherent and sticky outer surface.

18. Method according to claim 16, further comprising the steps of:

providing the polymeric layer on a support layer, wherein the step of treating the polymeric layer using suitable means to obtain the said adherent and sticky surface area on the surface of the photopolymeric layer is carried out while the polymeric layer is disposed on the support layer on the side opposing the support layer, providing the support layer with the treated polymeric layer disposed thereon as an intermediate web type article having longitudinal side edges, cutting off a portion of the article along parallel transverse cutting lines, wherein the cut-off portion is attached to the outer surface of the cylindrical sleeve so as to present a substantially uninterrupted exteriorly oriented smooth cylindrical adherent and sticky surface area to form the cylindrical printing form attachment means.

19. Method according to claim 18, wherein the transverse cutting lines are defined at an angle to the longitudinal side edges which is different from 90.

20. Printing form attachment means made of a photopolymeric material for removably attaching a flexographic printing form by adhesion on a plate cylinder of a printing press, the printing form attachment means comprises a treated polymeric printing form attachment layer made of a polymeric material which has sticky and adherent characteristics adapted to be located on the plate cylinder for removable adherent attachment of the printing form to the plate cylinder utilizing the sticky and adherent characteristics of the polymeric material, as well as a substantially rigid support sleeve having a hollow inside diameter complementary to the outside diameter of the plate cylinder of the printing machine and adapted to be mounted onto the plate cylinder, the photopolymeric material being located on an outer surface of the support sleeve.

21. Printing form attachment means according to claim 20, wherein the outer surface of the support sleeve is covered with a cut-off portion of a web type intermediate product comprising a support layer with the treated polymeric layer disposed thereon, the web type intermediate product being cut along a cutting line generally transverse to the side edges of the web, the cutting lines being disposed substantially against each other upon installation on the outer surface so that an uninterrupted externally oriented smooth cylindrical adherent and sticky surface area is presented.

22. Printing form attachment means according to claim 21, wherein the cutting lines form an angle with the side edges of the web so that the cutting lines present a helical orientation on the cylindrical form attachment means.

* * * * *